US006257436B1

(12) United States Patent
McGlauflin

(10) Patent No.: US 6,257,436 B1
(45) Date of Patent: Jul. 10, 2001

(54) CONVERTIBLE PASTRY STORAGE CONTAINER CONSTRUCTION

(76) Inventor: Andrew L. McGlauflin, 4 E. Temple Ave., 2nd Floor, Sellersville, PA (US) 18960

( * ) Notice: Subject to any disclaimer, the term of this patent is extended or adjusted under 35 U.S.C. 154(b) by 0 days.

(21) Appl. No.: 09/537,930

(22) Filed: Mar. 29, 2000

(51) Int. Cl.[7] ..... B65D 85/30
(52) U.S. Cl. ..... 220/533; 206/223; 220/23.87
(58) Field of Search ..... 220/532, 533, 220/23.87; 206/736, 216, 223

(56) References Cited

U.S. PATENT DOCUMENTS

| | | | | |
|---|---|---|---|---|
| 1,644,830 | * | 10/1927 | Henderson | 220/533 |
| 2,281,489 | | 4/1942 | Fritz | 312/150 |
| 2,695,112 | * | 11/1954 | Bonnevay | 220/533 |
| 4,261,465 | * | 4/1981 | Thomas | 220/533 |
| 4,446,966 | * | 5/1984 | Moloney | 220/533 |
| 4,714,158 | * | 12/1987 | Oltman et al. | 220/532 |
| 4,884,689 | * | 12/1989 | Su-Chin | 220/532 |
| 4,955,502 | | 9/1990 | Sorci | 220/22 |
| 5,257,721 | * | 11/1993 | Smith et al. | 220/533 |
| 5,277,329 | | 1/1994 | Pomroy et al. | 220/526 |
| 5,323,926 | | 6/1994 | Pomroy et al. | 220/526 |
| 5,390,815 | | 2/1995 | Spiegel | 220/529 |

* cited by examiner

*Primary Examiner*—Joseph M. Moy
(74) *Attorney, Agent, or Firm*—Henderson & Sturm LLP

(57) ABSTRACT

A convertible pastry storage container construction (10) that has one configuration adapted to store loose pastries (101) in different compartments and another configuration that can store a box of pastries (100). The construction includes a lid member (30) hingedly connected to a receptacle member (20) which defines a receptacle chamber (26) dimensioned to receive a box (100) of pastries. The interior of the receptacle member (20) is provided with a plurality of partition members (50) moveable from a vertical upright position to a stored position.

1 Claim, 2 Drawing Sheets

CONVERTIBLE PASTRY STORAGE CONTAINER CONSTRUCTION

BACKGROUND OF THE INVENTION

1. Field of the Invention

The present invention relates to the field of specialized storage containers in general, and in particular to a pastry storage container having moveable interior partitions.

2. Description of Related Art

As can be seen by reference to the following U.S. Pat. Nos. 2,281,489; 4,955,502; 5,277,329; 5,323,926; and 5,390,815, the prior art is replete with myriad and diverse compartmented storage compartments.

While all of the aforementioned prior art constructions are more than adequate for the basic purpose and function for which they have been specifically designed, they are uniformly deficient with respect to their failure to provide a simple, efficient, and practical compartmented storage container for either loose or boxed pastries such as donuts, bagels, and the like.

As most donut and bagel lovers are aware, these pastries stay fresh the longest when stored in a generally air tight container at room temperature.

In addition, while some people prefer storing the pastries in their original container which is in turn placed within a surrounding sealed enclosure, other people prefer to remove the pastries from their original container and place the pastries in an ordered manner in a compartmented sealable container.

As a consequence of the foregoing situation, there has existed a longstanding need for a new and improved pastry storage container construction that is quickly and easily convertible from a compartmented interior chamber designed to store loose pastry articles to a container that will store an entire box filled with loose pastry articles, and the provision of such a construction is a stated objective of the present invention.

BRIEF SUMMARY OF THE INVENTION

Briefly stated, the convertible pastry storage container that forms the basis of the present invention comprises in general a receptacle unit, a lid unit, and a plurality of removable partition units operatively associated with the receptacle unit.

As will be explained in greater detail further on in the specification, the lid unit is hingedly connected to the receptacle unit and the interior of the receptacle unit cooperates in a unique manner with the plurality of partition units such that the partition units can be deployed in a vertically upright position within the receptacle unit to define individual storage compartments within the receptacle unit, and in the alternative, the partition units can be removed and stored within the receptacle unit to define a single enlarged receptacle chamber which can receive a box of pastries in the receptacle unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
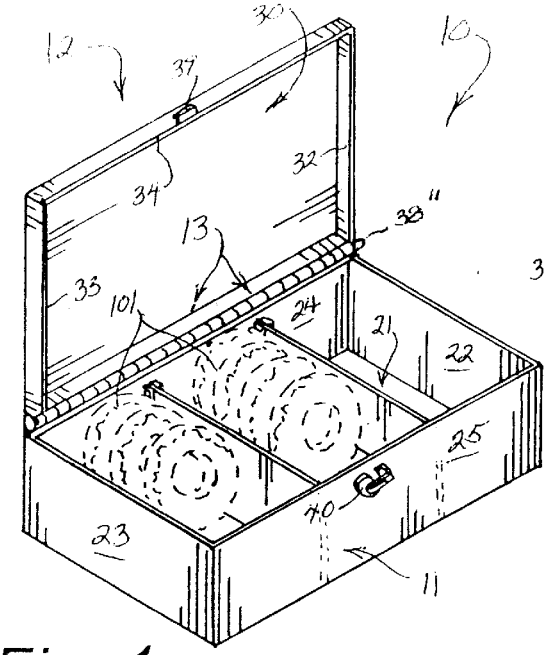
FIG. 1 is a perspective view of the compartmented loose pastry storage configuration of the invention.

As can be seen by reference to the drawings, and in particular to FIG. 1, the convertible pastry storage container construction that forms the basis of the present invention is designated generally by the reference number 10. The construction 10 comprises in general a receptacle unit 11, a lid unit 12, and a plurality of removable partition units 13. These units will now be described in seriatim fashion.

Figure 2:
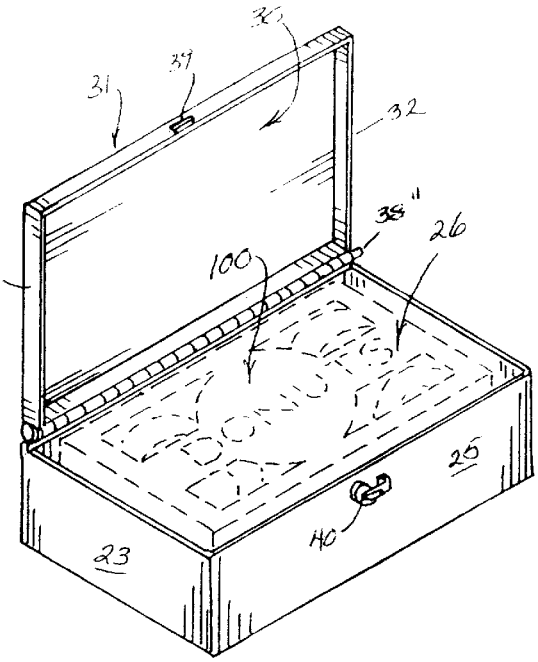
FIG. 2 is a perspective view of the whole box storage configuration of the invention.

As shown in FIGS. 1 and 2, the receptacle unit includes a generally rectangular receptacle member 20 having a floor 21, a pair of side walls 22, 23, a rear wall 24 and a front wall 25 which define a receptacle chamber 26. Furthermore, as shown in FIG. 3, the rear wall 24 is raised relative to the sidewalls 22, 23 and the front wall 25 and provided with a plurality of pairs of vertical rib elements 27.

Figure 3:
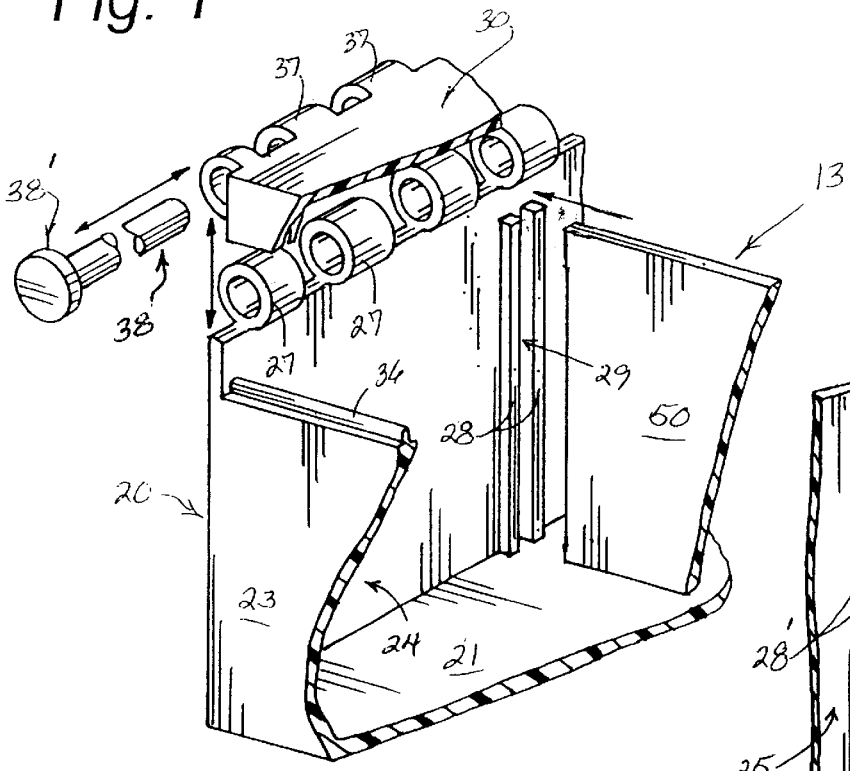
FIG. 3 is an enlarged detail view of the hinge assembly that connects the lid unit to the receptacle unit.

In addition, as can be seen by reference to FIG. 3, the upper portion of the rear wall 24 is provided with a plurality of barrel shaped eyelets 27. The rear wall 24 is slightly raised relative to the sidewalls 22, 23 and the front wall 25 and further provided with pairs of closely spaced vertical ribs 28 which define vertical slots 29.

Figure 4:
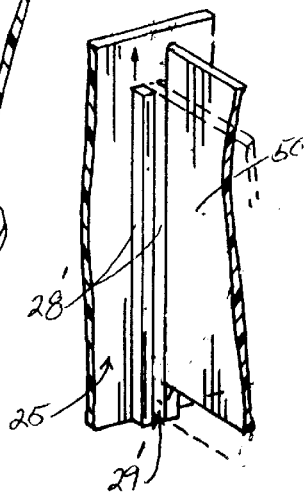
FIG. 4 is an isolated detail view of the engagement of one of the removable partition units with the receptacle unit.

Turning now to FIG. 4, it can be seen that the front wall 25 is also provided with pairs of closely spaced vertical ribs 28' which define vertical slots 29' which are aligned with the vertical slots 29 on the rear wall 24. The purpose and function of the vertical slots 29 and 29' will be described in greater detail further on in the specification.

As shown in FIGS. 1 through 3, and 5 through 8, the lid unit 11 comprises a generally rectangular lid member 30 having a downwardly depending peripheral skirt portion 31 which extends around the sides 32, 33 and the front 34 of the lid member 30. The bottom of the skirt portion 31 is provided with a recess 35 dimensioned to sealingly engage a raised rib 36 which projects upwardly from the top of the sidewalls 22, 23 and the front wall 25 of the receptacle member 20.

Figure 5:
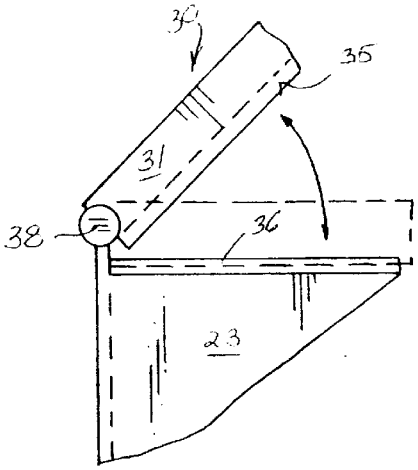
FIG. 5 is an end view of a portion of the hinge assembly.
Figure 6:
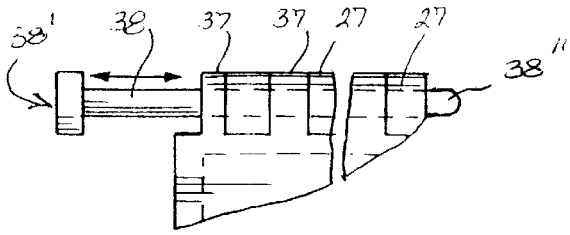
FIG. 6 is a top plan view of a portion of the hinge assembly.

In addition, as shown in FIGS. 3, 5, and 6, the inboard end of the lid member 30 is further provided with a plurality of barrel shaped eyelets 37 which are adapted to be pressed into alignment with the barrel shaped eyelets 27 on the receptacle member 20. The eyelets 27 and 37 are dimensioned to receive an elongated, removable pivot rod 38 to form a hinged connection between the lid member 30 and the receptacle member 20.

In addition, as shown in FIGS. 3 and 6, the pivot rod 38 has an enlarged head 38' formed on one end and is dimensioned such that the other end 38" will project beyond the barrel shaped eyelets 37, 27 on the lid member 30 and the receptacle member 20 to facilitate the removal of the pivot rod 38 for cleaning.

Figure 7:
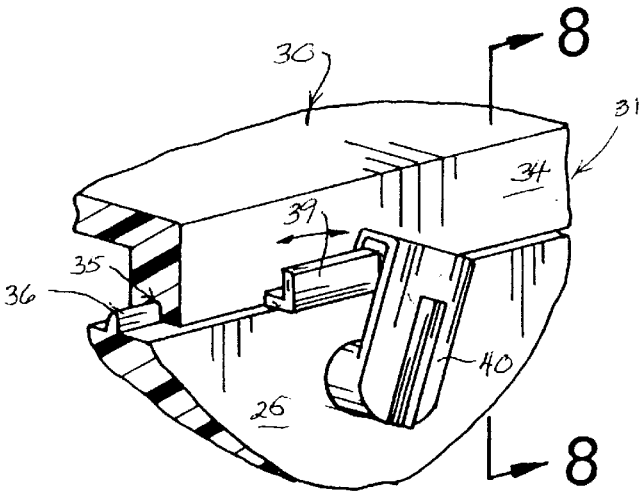
FIG. 7 is an isolated detail view of the latch assembly on the front of the receptacle and lid units.
Figure 8:
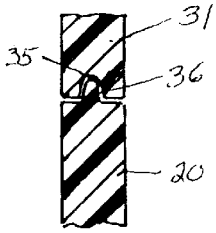
FIG. 8 is a cross sectional view taken through line 8—8 of FIG. 7.

Furthermore, as shown in FIG. 7, the front skirt portion 34 of the lid member 30 is provided with a catch element 39 which is adapted to be releasably engaged by a pivoted latch element 40 provided on the front wall 25 of the receptacle member 20.

As can best be seen by reference to FIGS. 3 and 4, each of the plurality of removable partition units 13 include a generally rectangular partition member 50. The opposite ends of the partition member are adapted to be received in the vertical slots 29, 29' on the rear 24 and front 25 walls of the receptacle member 20 in a well recognized manner to create interior compartments of different widths.

As shown in FIG. 4, the partition members 50 are vertically deposited into the slots 29, 29' to create the partitioned configuration of the construction 10 as depicted in FIG. 1. However, should the user wish to store the pastries 101 in their original container 100 as depicted in FIG. 2, all that is required is to lift each of the partition members 50 upwardly to either remove the partition members 50 from the receptacle member 20 or for storage in the bottom of the receptacle member 20 wherein the interior of the receptacle member 20 can now accommodate the original container 100.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A convertible pastry storage container construction being sized for selectively storing either a plurality of loose pastries in separate compartments or a box containing said pastries wherein the construction consists of a receptacle unit including a receptacle member having a floor and a plurality of walls that define a receptacle chamber dimensioned to receive said box of pastries:

a lid unit including a lid member hingedly connected to said receptacle member; wherein both the receptacle member and the lid member are provided with a plurality of barrel shaped eyelets that are alignable with one another;

a pair of partition units operatively associated with said receptacle unit wherein each partition unit includes a partition member moveable from an upright position within said receptacle chamber to a stored position within said receptacle chamber, wherein two of the plurality of walls in the receptacle member are opposed relative to one another and provided with pairs of closely spaced vertical ribs which define vertical slots which are aligned with the vertical slots in the opposed wall wherein the opposed pairs of vertical slots are dimensioned to receive said pair of partition units; and an elongated pivot rod dimensioned to be removably received in and extend through said aligned barrel shaped eyelets, wherein the elongated pivot rod has opposite ends where one end is provided with an enlarged head and the other end is dimensioned to project beyond said aligned barrel shaped eyelets.

* * * * *